US010374280B2

(12) United States Patent
Laighton et al.

(10) Patent No.: US 10,374,280 B2
(45) Date of Patent: Aug. 6, 2019

(54) QUADRATURE COUPLER

(71) Applicant: Raytheon Company, Waltham, MA (US)

(72) Inventors: Christopher M. Laighton, Boxborough, MA (US); Susan C. Trulli, Lexington, MA (US); Elicia K. Harper, Chelsea, MA (US)

(73) Assignee: Raytheon Company, Waltham, MA (US)

( * ) Notice: Subject to any disclaimer, the term of this patent is extended or adjusted under 35 U.S.C. 154(b) by 59 days.

(21) Appl. No.: 15/621,150

(22) Filed: Jun. 13, 2017

(65) Prior Publication Data

US 2018/0358676 A1 Dec. 13, 2018

(51) Int. Cl.
*H01P 5/18* (2006.01)
*H01P 5/12* (2006.01)

(52) U.S. Cl.
CPC ..... *H01P 5/187* (2013.01)

(58) Field of Classification Search
CPC ..... H01P 5/18; H01P 5/184; H01P 5/187
USPC ..... 333/109–112, 116, 117
See application file for complete search history.

(56) References Cited

U.S. PATENT DOCUMENTS 3,506,932 A 4/1970 Beurrier
4,821,007 A * 4/1989 Fields ..... H01P 3/085 174/266
5,446,425 A * 8/1995 Banba ..... H01P 5/185 333/116
5,570,069 A 10/1996 Franke
5,892,400 A 4/1999 van Saders et al.
6,114,912 A 9/2000 Ashby et al.
6,437,661 B2 * 8/2002 Nishimura ..... H01P 5/187 333/116
6,483,398 B2 * 11/2002 Nagamori ..... H01P 5/185 333/101

(Continued)

FOREIGN PATENT DOCUMENTS

CN 101958450 A 1/2011
EP 2 816 729 A1 12/2014

(Continued)

OTHER PUBLICATIONS

Vijayan T, Performance of Microstrip Directional Coupler Using Synthesis Technique, Mar. 2013, IJAREEIE, vol. 2, Issue 3, 7 pages.*

(Continued)

*Primary Examiner* — Dean O Takaoka
(74) *Attorney, Agent, or Firm* — Daly, Crowley, Mofford & Durkee, LLP

(57) ABSTRACT

A quadrature coupler having: a pair of overlying strip conductors separated by a first dielectric layer to provide a coupling region between the coupling region of overlying strip conductors; a pair of opposing ground pads, the coupling region being disposed between the pair of opposing ground pads; a second dielectric layer disposed over the coupling region and between the pair of opposing ground pads; and an electrically conductive shield layer disposed over the second dielectric layer, extending over opposing sides of the dielectric layer and onto the pair of opposing ground pads. Portions of coupler are formed by printing or additive manufacturing.

18 Claims, 8 Drawing Sheets

(56) References Cited

U.S. PATENT DOCUMENTS

| | | | | |
|---|---|---|---|---|
| 6,600,301 | B1 | 7/2003 | DeFalco | |
| 6,759,923 | B1 * | 7/2004 | Scott | H01P 5/185 333/116 |
| 6,956,449 | B2 * | 10/2005 | Snyder | H01P 5/187 333/116 |
| 7,015,771 | B2 | 3/2006 | Pelz | |
| 7,088,201 | B2 * | 8/2006 | Piernas | H01P 5/187 333/116 |
| 7,576,626 | B2 * | 8/2009 | Gorbachov | G01R 27/06 333/108 |
| 7,876,157 | B1 | 1/2011 | Kang et al. | |
| 8,854,140 | B2 | 10/2014 | Bettencourt et al. | |
| 2005/0017821 | A1 | 1/2005 | Sawicki | |
| 2009/0051462 | A1 | 2/2009 | Rottmoser et al. | |
| 2010/0039168 | A1 | 2/2010 | Bettencourt | |
| 2017/0179564 | A1 * | 6/2017 | Petrucelli | H01P 5/184 |

FOREIGN PATENT DOCUMENTS

| | | |
|---|---|---|
| JP | H0884007 A | 3/1996 |
| WO | WO 97/23037 | 6/1997 |

OTHER PUBLICATIONS

Tehrani et al.; Inkjet-Printed 3D Interconnects for Millimeter-Wave System-on-Package Solutions. 2016 IEEE MTT-S International Microwave Symposium (IMS), San Francisco, CA; Jan. 1, 2016; 4 pages.

A. Gámez-Machado, D. Valdés-Martín, A. Asensio-López, J. Gismero-Menoyo, Microstrip-to-stripline planar transitions on LTCC, 2011, IEEE,4 pages.

C.Y, Ng, M. Chongeheawchamnan, I.D. Robertson, Miniature Ka-Band I/Q Vector Modulator using 3D-MMIC Technology, 33rd European Microwave Conference, Munch 2003, 4 pages.

Juno Kim, Hai-Young Lee, Tatsuo Itoh, Novel Microstrip-To-Stripline Transactions For Leakage Supression in Multilayer Microwave Circuits, 1998, IEEE, 4 pages.

Velijko Crnadak, Siniša Tasic, Improved VHF Quadrature Hybrid Coupler, 2016, IEEE 4 pages.

Fred Bonn, Bias Schemes for Enhancement and Depletion Mode GaAsFETS in Source-Follower Configuration, Motorola, Inc. Technical Developments, Mar. 1993, vol. 18, pp. 88-90, 3 pages.

Kazior, T.E. ; Chelakara, R. ; Hoke, W. ; Bettencourt, J. ; Palacios, T. ; Lee. H.S. "High Performance Mized Signal and RF Circuits Enabled by the Direct Monolothic Heterogeneous Integration of GaN HEMTs and Si CMOS on a Silicon Subrate", Compound Semiconductor Integrated Circuit Symposium (CSICS), 2011 IEEE DOI: 10.1109/CSICS.2011.6062443, pp. 1-4.

PCT Notification of Transmittal of International Search Report and the Written Opinion of the International Searching Authority, or the Declaration, PCT/US2016/036546; dated Sep. 16, 2016, 1 page.

PCT International International Search Report, PCT/US2016/036546, dated Sep. 16, 2016, 6 pages.

PCT Written Opinion of the ISA, PCT/US2016/036546; dated Sep. 16, 2016, 7 pages.

PCT Notification of Transmittal of International Preliminary Report on Patentability (Chapter I of the Patent Cooperation Treaty), PCT/US2016/036546; dated Dec. 28, 2017, 1 page.

PCT International Preliminary Report on Patentability, PCT/US2016/036546, dated Dec. 19, 2017, 1 page.

PCT Written Opinion of the ISA, PCT/US2016/036546; dated Dec. 28, 2017, 6 pages.

RCE and Response to Final Office Action dated Nov. 1, 2018 for U.S. Appl. No. 15/893,269 as filed on Dec. 6, 2018; 7 Pages.

Notification of Transmittal of the International Search Report & Written Opinion of the ISA dated Oct. 10, 2018 for International Application No. PCT/US2018/036581; 1 Page.

International Search Report dated Oct. 10, 2018 for International Application No. PCT/US2018/036581; 5 Pages.

Written Opinion of the ISA dated Oct. 10, 2018 for International Application No. PCT/US2018/036581; 10 Pages.

Sachse, et al.; "Quasi-Ideal Multilayer Two- and Three-Strip Directional Couplers for Monolithic and Hybrid MIC's"; IEEE transactions on Microwave Theory and Techniques; pp. 1873-1882; Jan. 1, 1999; 10 Pages.

* cited by examiner

QUADRATURE COUPLER

TECHNICAL FIELD

This disclosure relates generally to quadrature hybrid couplers.

BACKGROUND

As is known in the art, quadrature couplers are used in a variety of microwave circuits to split an input signal into a pair of output signals, usually with equal magnitudes, that are ninety degrees apart in phase. Examples of such quadrature couplers are an embedded stripline broadside coupler or a topside quadrature coupler, such as a Lange or hybrid (branchline) splitter. One use of quadrature couplers is to impedance match pairs of devices. The devices are arranged so that reflections from them are terminated in a load that is isolated from the quadrature coupler's input because of the 90 degree (quadrature) phase difference.

As is also known in the art, prior art quadrature couplers are integrated into a larger board that has many functions. As such, the design such as the degree of coupling, is not easy alterable.

SUMMARY

In accordance with the present disclosure, a quadrature coupler is disclosed having: a pair of overlying strip conductors separated by a first dielectric layer to provide a coupling region between the pair of overlying strip conductors; a pair of opposing ground pads, the coupling region being disposed between the pair of opposing ground pads; a second dielectric layer disposed over the coupling region and between the pair of opposing ground pads; and an electrically conductive shield layer disposed over the second dielectric layer, extending over opposing sides of the dielectric layer and onto the pair of opposing ground pads.

With such an arrangement, the shield provides improved electrical isolation for the coupling region.

In one embodiment, portions of the coupler are formed by printing or additive manufacturing.

With such an arrangement, printing or additive manufacturing enables the coupler strip conductor widths and hence the degree of coupling between the pair of strip conductors to be adjusted, or tuned, while the coupler is still on a board having multiple functionality.

In one embodiment, a directional coupler includes a second pair of ground pads, the coupling region being disposed between the second pair of ground pads, and the first-mentioned pair of ground pads. The first-mentioned pair of ground pads and the second pair of ground pads are disposed along perpendicular lines. The electrically conductive shield layer is disposed over a second pair of opposing sides of the dielectric layer and onto the second pair of ground pads.

In one embodiment, a quadrature coupler is provided having: a dielectric substrate and a first metal layer disposed on an upper surface of the substrate. The first metal layer is patterned to provide: a pair of ground pads; a first lower strip conductor, spaced from the pair of ground pads, having: an input at first end, an output at a second end; and, a coupling region disposed between the first end, the second end, and between the pair on ground pads; a second lower strip conductor having: an input end and an output end; and, a third lower strip conductor having an input end and an output end. A first dielectric layer is disposed over the coupling region. A second metal layer is configured as a strip conductor disposed on the first dielectric layer over the coupling region. The second metal layer has one end disposed on, and electrically connected to, the output end of the second lower strip conductor and has a second end disposed on, and electrically connected to the input end of the third lower strip conductor. A second dielectric layer is disposed over the second metal layer and between the pair of ground pads. An electrically conductive shield layer is disposed on an upper surface of the second dielectric layer extending over sides of the second dielectric layer and onto the pair of ground pads.

In one embodiment, a method is provided for tuning a quadrature coupler, comprising: (a) providing a quadrature coupler comprising: a pair of overlaying strip conductors separated by a dielectric layer; (b) measure a degree coupling between the pair of strip conductors; (c) comparing the measured degree of coupling with a predetermined degree of coupling; (d) adjusting a width of an upper one of the pair of strip conductors; (e) repeating (a) through (d) until the degree of coupling reaches the predetermined degree coupling.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

FIGS. 1B and 1C being taken along lines 1B-1B and 1C-1C, respectively in FIG. 1A;

FIGS. 5B and 5C being taken along lines 5B-5B and 5C-5C, respectively in FIG. 5A.

Like reference symbols in the various drawings indicate like elements.

DETAILED DESCRIPTION

Figure 1B:
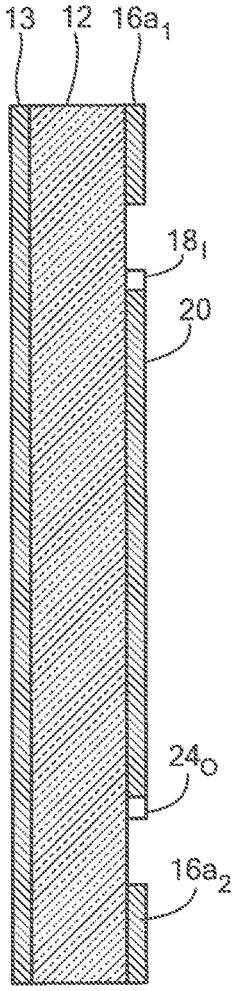
FIGS. 1A-1C through 5A-5C are diagrammatical plan, perspective, and cross sectional views of a quadrature coupler according to the disclosure at various stages in the fabrication thereof.
Figure 1A:
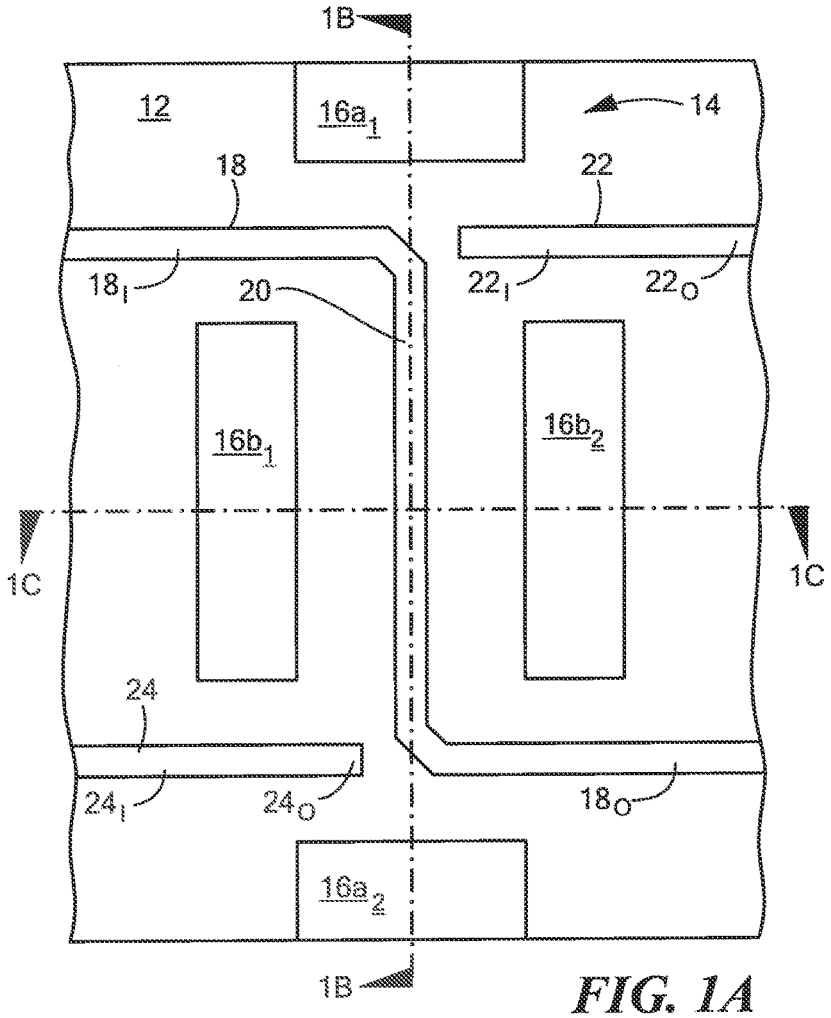
Figure 1C:
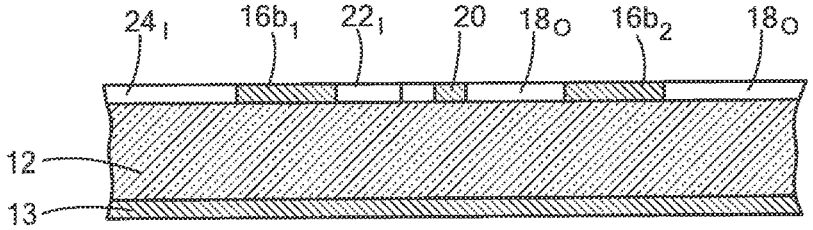

Referring now to FIGS. 1A, 1B and 1C, a dielectric substrate 12 is shown having: a first metal layer 14 disposed on an upper surface of the substrate 12; and a ground plane conductor 13, here for example gold, is disposed on a bottom surface of the substrate 12. The first metal layer 14 is patterned to provide: a two pairs of ground pads; pair $\mathbf{16}a_1$, $\mathbf{16}a_2$, and pair $\mathbf{16}b_1$, $\mathbf{16}b_2$, respectively, as shown; a first lower strip conductor 18, spaced from the pair of ground pads, having: an input at first end $\mathbf{18}_I$, an output at a second end $\mathbf{18}_O$; and, a coupling region 20 disposed between the first end $\mathbf{18}_I$, the second end $\mathbf{18}_O$, and between the two pairs on ground pads $\mathbf{16}a_1$, $\mathbf{16}a_2$, and pair $\mathbf{16}b_1$, $\mathbf{16}b_2$, respectively, as shown; a second lower strip conductor 22 having:

an input end $22_I$ and an output end $22_O$; and, a third lower strip conductor 24 having an input end $24_I$ and an output end $24_O$, as shown. The first metal layer 14 may be printed, formed using additive manufacturing, or formed using conventional photolithographic-etching processing, as used in forming printed circuit boards, for example.

Figure 2B:
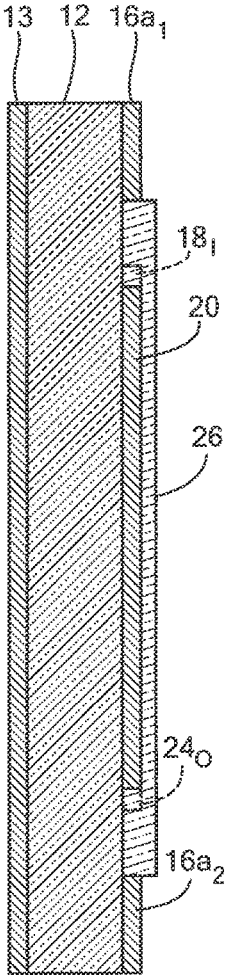
FIGS. 2B and 2C being taken along lines 2B-2B and 2C-2C, respectively in FIG. 2A.
Figure 2A:
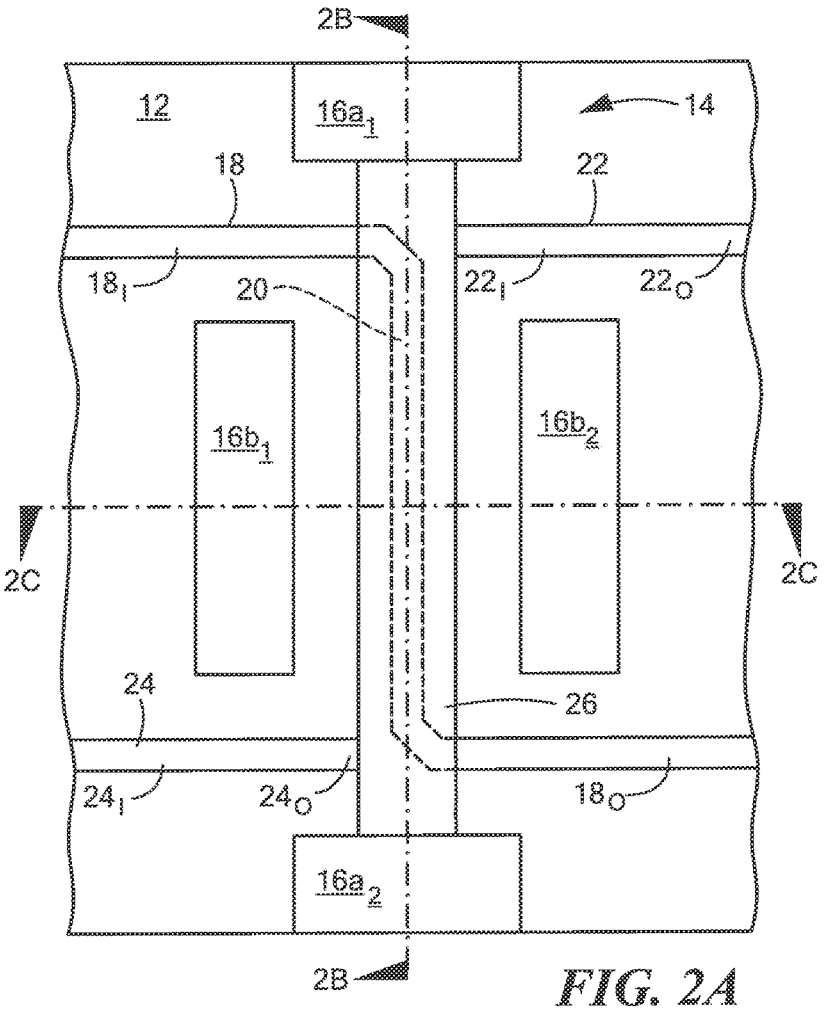
Figure 2C:
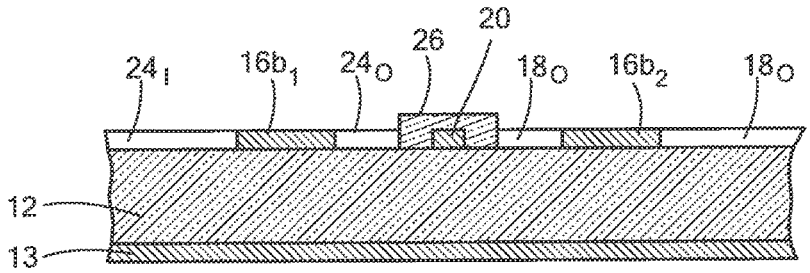

Referring now to FIGS. 2A-2C, a first dielectric layer 26, here for example epoxy based dielectric ink 118-12 from Creative Materials, Ayer, Mass. is disposed over the coupling region 20 using printing or additive manufacturing, for example.

Referring now to FIGS. 3A-3D, a second metal layer, strip conductor 28 here printed or formed by additive manufacturing, for example, using a conductive ink, for example, Paru nanosilver PG-007 or Dupont CB028, as a strip conductor disposed on the first dielectric layer 20. It is noted that portions 28*a* and 28*b* of the second metal layer are formed over portions of the outer sidewalls of the first dielectric layer 26 onto portions of the output end $24_o$ of the lower strip conductor 24 and onto portions of the input end $22_I$ of the third lower strip conductor 22. Thus, second metal layer 28 has one end 28*a* disposed on, and electrically connected to, the input end 22, of the second lower strip conductor 22 and has a second end 28*b* disposed on, and electrically connected to the output end $24_O$ of the third lower strip conductor 24. The width of the second metal layer 28 over the coupling region 20 may be adjusted by the additive manufacturing or printing process to tune the quadrature coupler 10.

Figure 4B:
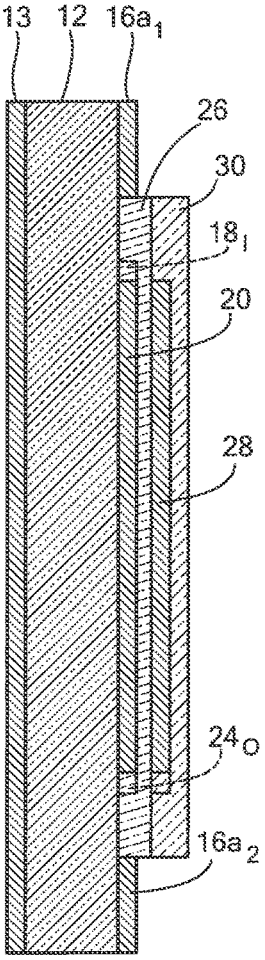
FIGS. 4B and 4C being taken along lines 4B-4B and 4C-4C, respectively in FIG. 4A.
Figure 4A:
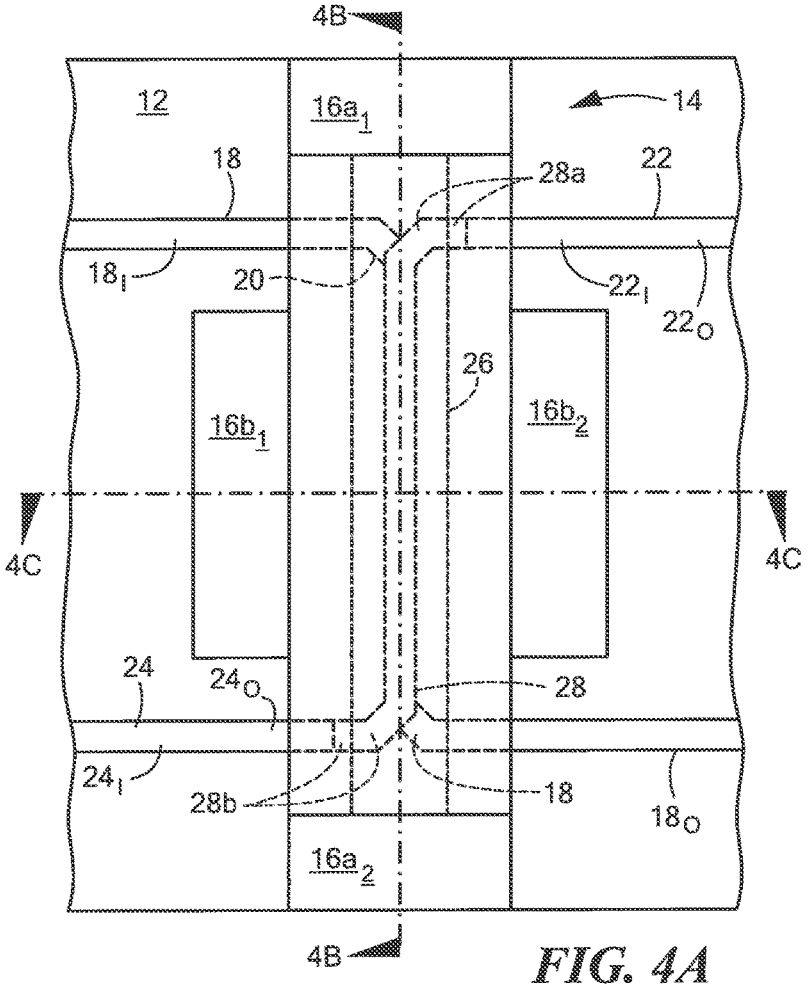
Figure 4C:
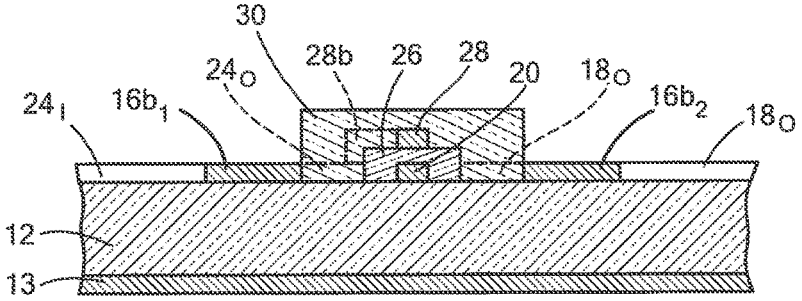

Referring now to FIGS. 4A-4C, a second dielectric layer 30 is disposed over the second metal layer 28 and between the two pairs of ground pads $16a_1$, 16*a*, and pair $16b_1$, $16b_2$, as shown. The second dielectric layer 30 may be printed or formed by additive manufacturing, for example, using any suitable dielectric, for example epoxy based dielectric ink 118-12 from Creative Materials, Ayer, Mass.

Figure 5B:
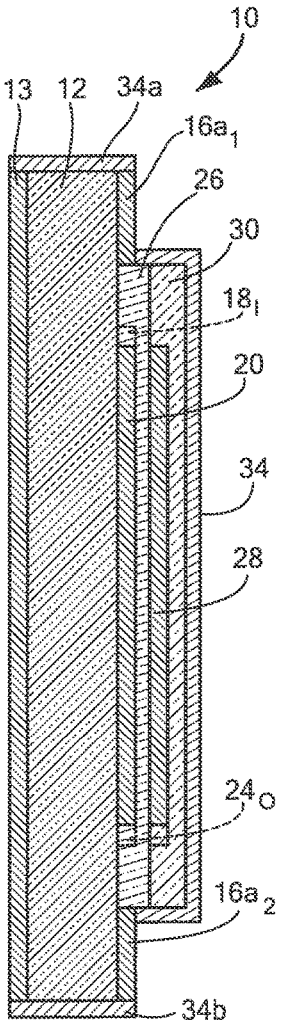
Figure 5A:
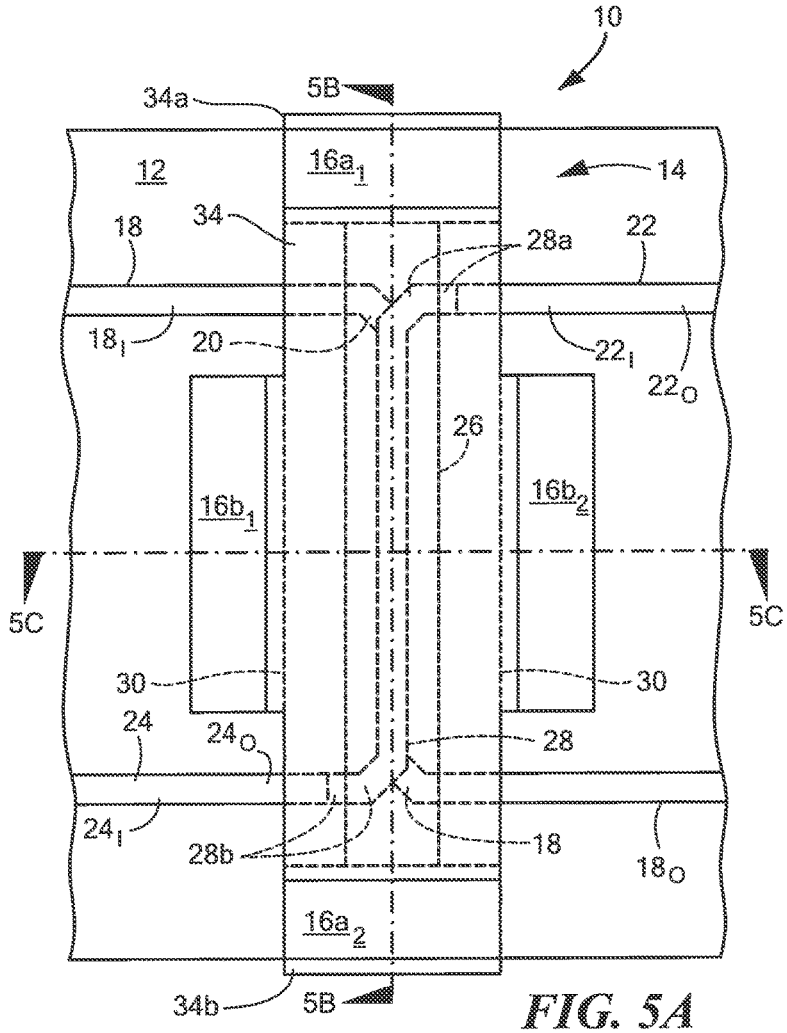
Figure 5C:
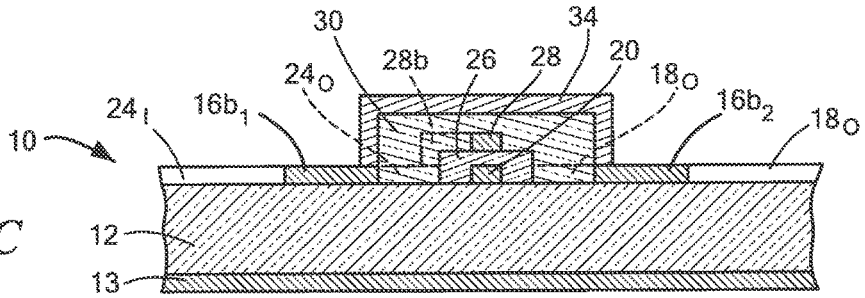

Referring now to FIGS. 5A-5C, an electrically conductive shield layer 32 is disposed on an upper surface of the second dielectric layer 30 extending over sides of the second dielectric layer 30 and onto the pair of ground pads $16a_1$, $16a_2$, and pair $16b_1$, $16b_2$, as shown. Conductive layers 34*a*, 34*b* are disposed on the sides of the substrate 12 to electrically connect the ground pads $16a_1$, $16a_2$ to the ground plane conductor 13, as shown, thereby completing the quadrature coupler 10. It is noted that the conductive shield layer 32 and conductive layers 34*a*, 34*b* are here printed or formed by additive manufacturing, for example, using a conductive ink, for example Para nanosilver PG-007 or DuPont CB028.

Figure 6A:
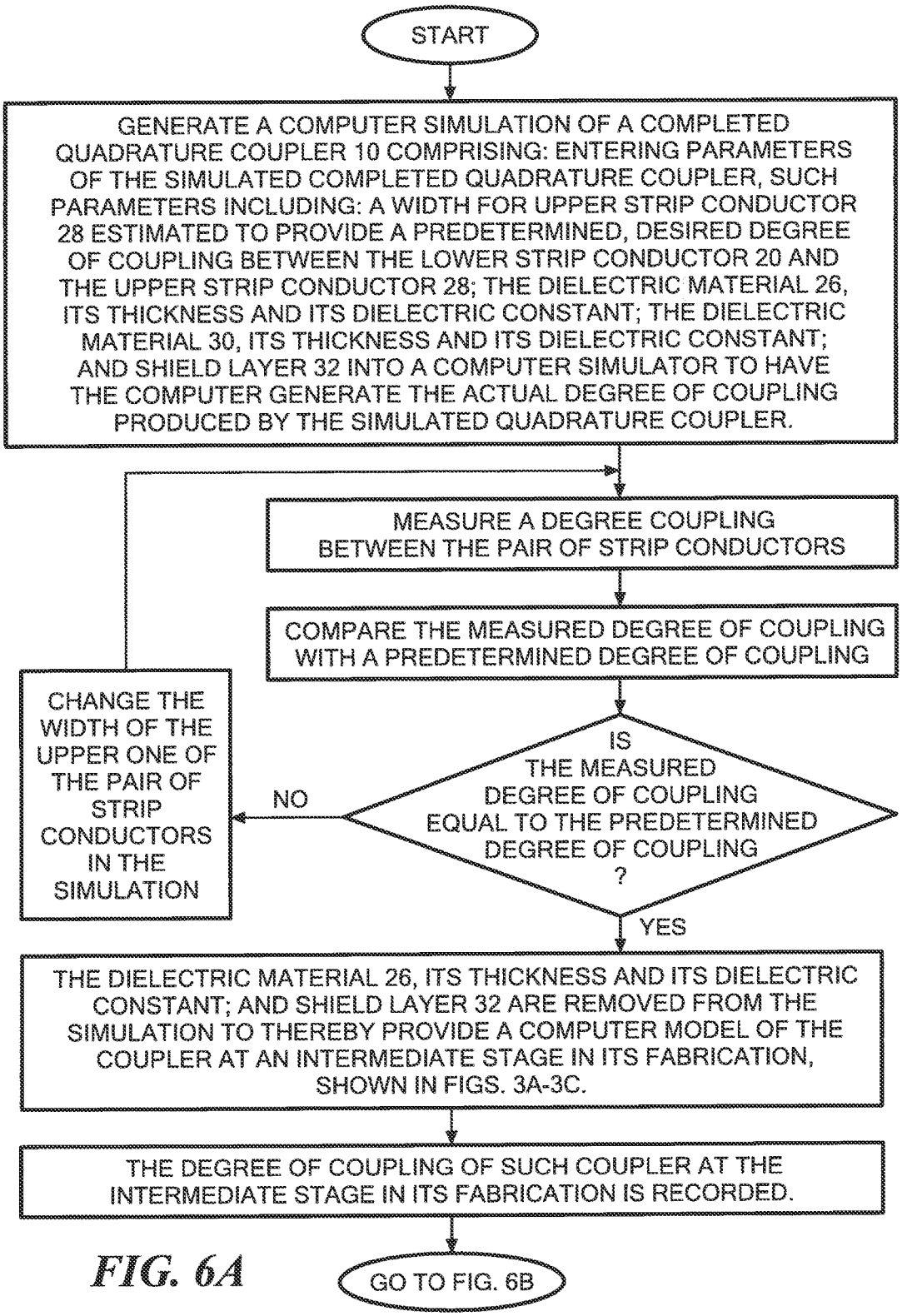
FIGS. 6A and 6B are flow charts of steps used in the process used to fabricate the quadrature coupler of FIGS. 5A-5C.
Figure 6B:
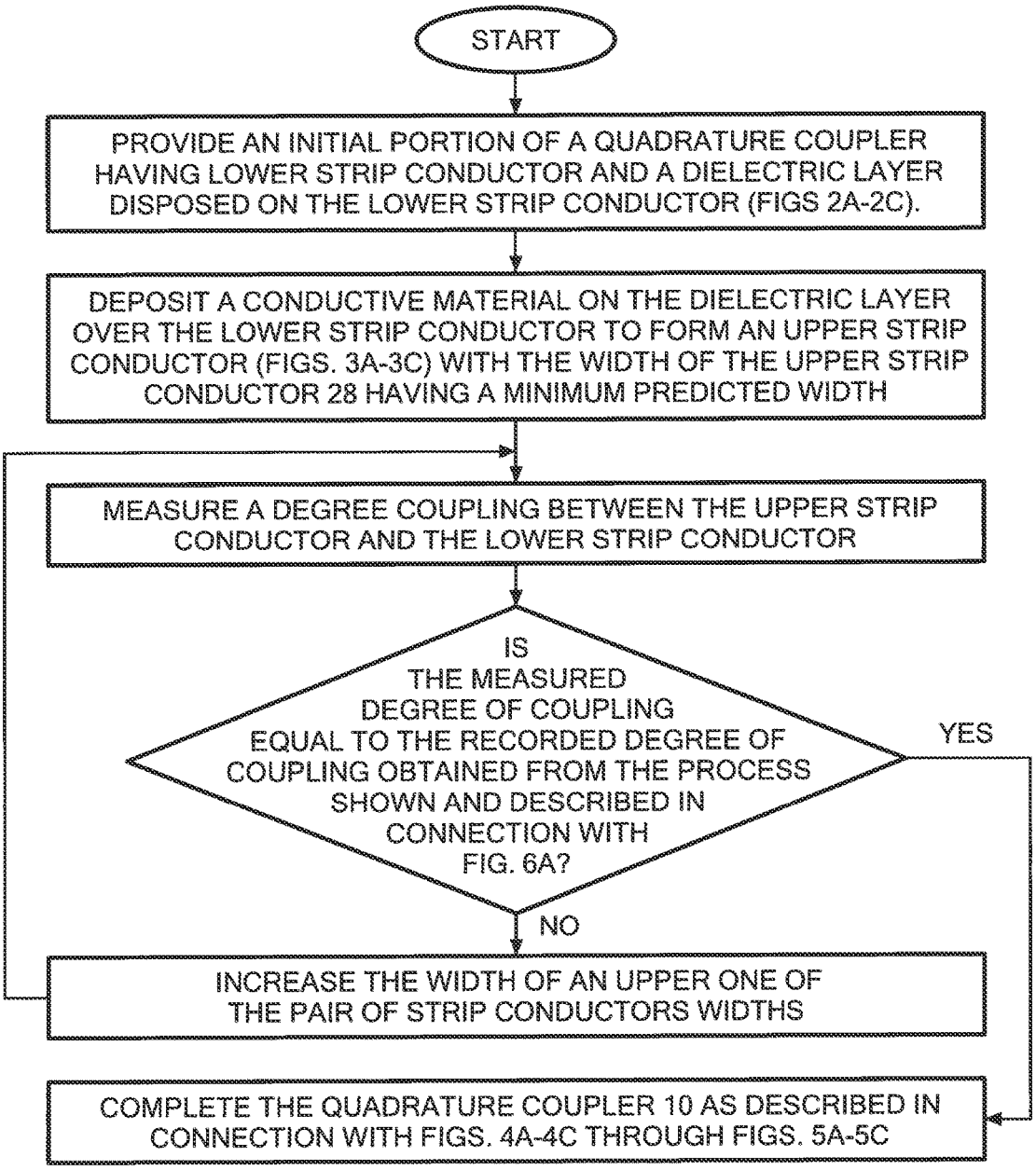

Because of the additive manufacturing printing process, the quadrature coupler 10 can be easily tuned. More particularly, referring to FIGS. 6A and 6B, first, prior to the manufacturing process a determination is made as to the width required for the strip conductor 28 prior to forming the dielectric material 30 (FIGS. 5A-5C) so that the competed quadrature coupler 10 will have a proper width to produce quadrature coupler 10 with a desired, predetermined degree of coupling between the upper strip conductor 28 and the lower strip conductor 20 after forming the dielectric material 30 and shield 34. Thus, referring to FIG. 6A, a computer simulation, using, for example 3-dimensional electro-magnetic simulator such as Ansys-HFFS (Ansys corporation, Canonsburg, Pa. 15317) is used to model a completed quadrature coupler 10 comprising: entering parameters of the simulated completed quadrature coupler, such parameters including: a width for upper strip conductor 28 estimated to provide a predetermined, desired degree of coupling between the lower strip conductor 20 and the upper strip conductor 28; the dielectric materiel 26, its thickness and its dielectric constant; the dielectric materiel 30, its thickness and its dielectric constant; and shield layer 32 into a computer simulator to have the computer generate the actual degree of coupling produced by the simulated quadrature coupler. From the generated actual degree of coupling, a comparison is made between the generated actual degree of coupling and a predetermined desired degree of coupling. If the generated actual degree of coupling and the predetermined desired degree of coupling are different, the width of the upper strip conductor 28 in the simulation is changed and the process continues until they are equal. Next, the dielectric material 26, its thickness and its dielectric constant; and shield layer 32 are removed from the simulation to thereby provide a computer model of the coupler at an intermediate stage in its fabrication, shown in FIGS. 3A-3C. Next, the degree of coupling of such coupler at the intermediate stage in its fabrication is recorded.

Figure 3B:
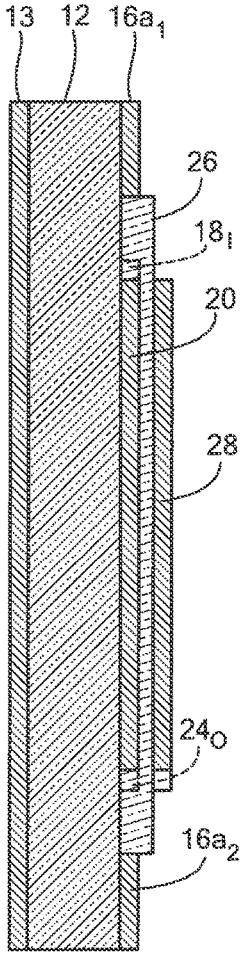
FIGS. 3B and 3C being taken along lines 3B-3B and 3C-3C, respectively in FIG. 3A.
Figure 3A:
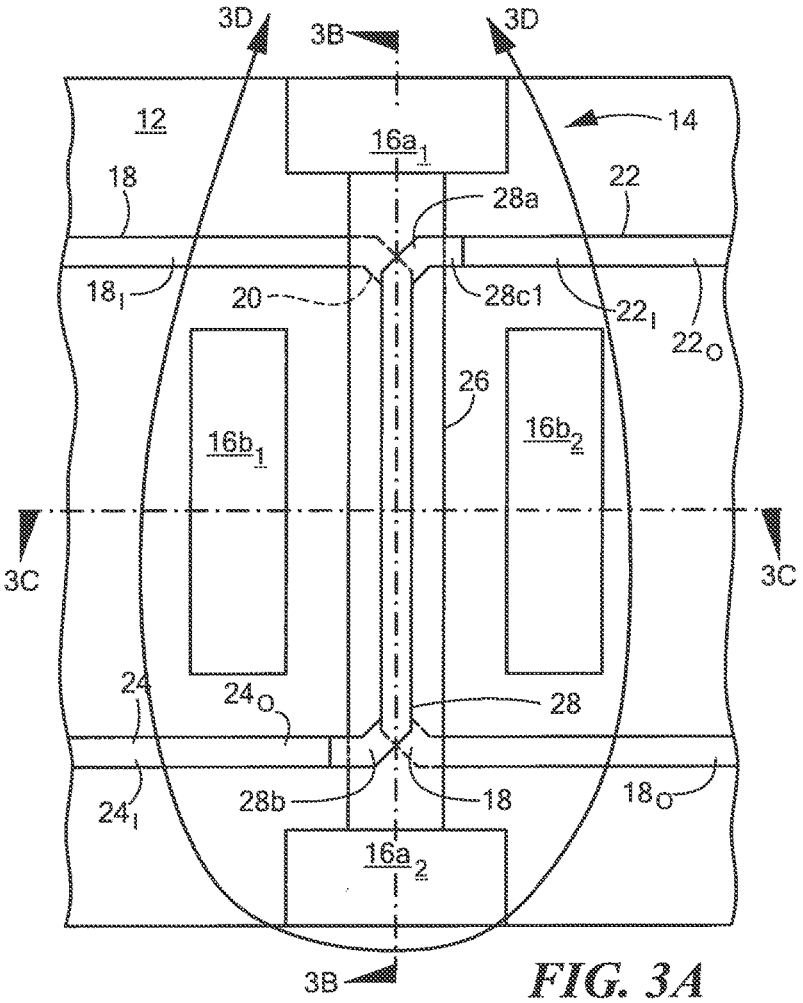
FIG. 3D being a perspective view of a region indicated as 3D-3D in FIG. 2A.
Figure 3C:
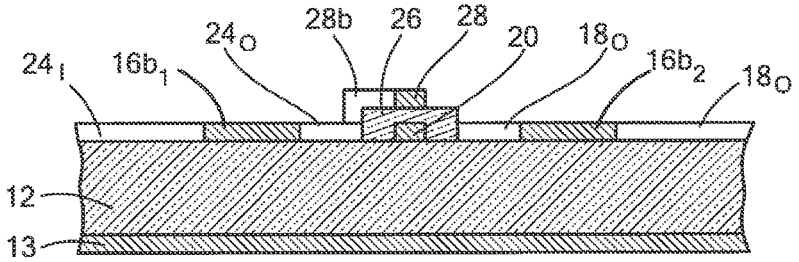
Figure 3D:
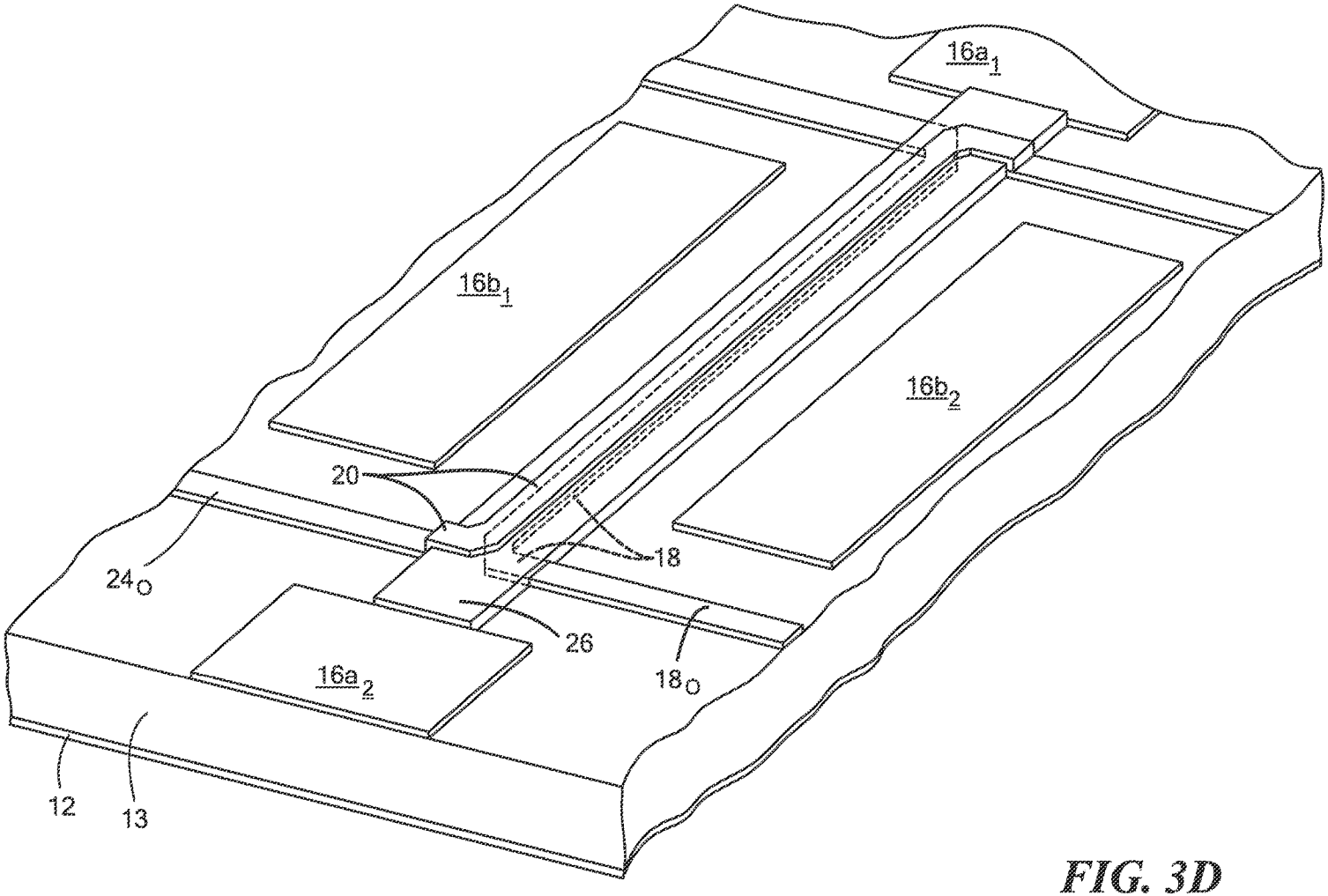

This recorded degree of coupling is used during the actual fabrication of the quadrature coupler 10. More particularly, referring to FIG. 6B, the fabrication process includes: (a) providing the quadrature coupler after completion of the structure shown in FIGS. 3A-3C with the width of the upper strip conductor 28 having a minimum predicted width; (b) measuring the degree coupling between the pair of strip conductors using any conventional process such as for example an S-parameter analyzer; (c) comparing the measured degree of coupling with the recorded degree of coupling; (d) incrementally increasing the width of the upper strip conductor 28 (FIGS. 3A-3C); (e) repeating (b) through (d) until the degree of coupling reaches the recorded degree coupling; and (f) complete the quadrature coupler 10 as described above and in connection with FIGS. 4A-4C through 5A-5C. It should be understood that instead of setting a minimum coupler specification and line width 28 and increasing line width 28 to achieve the desired coupler, a nominal or larger line width for 28 for the coupler can be used and techniques such as laser trim or milling tools can be used to reduce the line width to the desired level.

A number of embodiments of the disclosure have been described. Nevertheless, it will be understood that various modifications may be made without departing from the spirit and scope of the disclosure. For example, instead of Conductive layers 34*a*, 34*b* disposed on the sides of the substrate 12 to electrically connect the ground pads $16a_1$, $16a_2$ to the ground plane conductor 13, the ground pads $16a_1$, $16a_2$, and pair $16b_1$, $16b_2$, may be connected to the ground plane conductor 13 with electrically conductive vias passing through the substrate 12. These vias may be formed prior to forming the first metal layer 14 (FIGS. 1A-1C). Accordingly, other embodiments are within the scope of the following claims.

What is claimed is:

1. A radio frequency coupler, comprising:

a dielectric substrate;

a pair of strip conductors disposed over an upper surface of the dielectric substrate, a first portion of the pair of strip conductors being in an overlying relationship and separated by a first dielectric layer to provide a coupling region between the portion of the pair of strip conductors in the overlying relationship; a second portion of the pair of strip conductors being disposed on the upper surface of substrate;

a pair of opposing ground pads disposed on, and separated by, different portions of the upper surface of the substrate, the coupling region being disposed between the pair of opposing ground pads;

a second dielectric layer disposed over the coupling region and between the pair of opposing ground pads;

an electrically conductive shield layer disposed over the second dielectric layer, extending over opposing sides of the second dielectric layer and onto the pair of opposing ground pads.

2. The radio frequency coupler recited in claim 1 including a second pair of ground pads disposed on, and separated by, different portions the upper surface of the substrate, the coupling region being disposed between the second pair of ground pads, the first-mentioned pair of ground pads, the first-mentioned pair of ground pads and the second pair of ground pads being disposed along perpendicular lines, the electrically conductive shield layer being disposed over a second pair of opposing sides of the dielectric layer and onto the second pair of ground pads.

3. The radio frequency coupler recited in claim 2 wherein one of the second portion of the pair of strip conductors pass between one of the first mentioned pair of ground pads and one of the second pair of ground pads.

4. The radio frequency coupler recited in claim 3 wherein a second one of the second portion of the pair of strip conductors pass between a second one of the first mentioned ground pads and a second one of the second pair of ground pads.

5. The radio frequency coupler recited in claim 1 wherein the electrically conductive shield layer is a conductive ink.

6. The radio frequency coupler recited in claim 1 wherein portions of the electrically conductive shield layer are disposed on sides of the first dielectrics layer and sides of the second dielectric layer and over on portions of the upper surface of the dielectric substrate.

7. The radio frequency coupler recited in claim 6 including a second pair of ground pads disposed on, and separated by, different portions the upper surface of the substrate, the coupling region being disposed between the second pair of ground pads, the first-mentioned pair of ground pads, the first-mentioned pair of ground pads and the second pair of ground pads being disposed along perpendicular lines, the electrically conductive shield layer being disposed over a second pair of opposing sides of the dielectric layer and onto the second pair of opposing ground pads.

8. The radio frequency coupler recited in claim 7 wherein a first one of the second portion of the pair of strip conductors pass between one of the first mentioned pair of ground pads and one of the second pair of ground pads.

9. The radio frequency coupler recited in claim 8 wherein a second one of the second portion of the pair of strip conductors pass between a second one of the first mentioned ground pads and a second one of the second pair of ground pads.

10. The radio frequency coupler recited in claim 8 wherein the electrically conductive shield layer is a conductive ink.

11. The radio frequency coupler recited in claim 9 wherein the electrically conductive shield layer is a conductive ink.

12. A radio frequency coupler, comprising:

a dielectric substrate;

a first metal layer disposed on an upper surface of the substrate, the first metal layer being patterned to provide:

a pair of ground pads disposed on, and separated by, different portions of the dielectric substrate;

a first lower strip conductor, spaced from the pair of ground pads, having: an input at first end, an output at a second end; and, a coupling region disposed between the first end, the second end, and between the pair of ground pads;

a second lower strip conductor having: an input end and an output end; and, a third lower strip conductor having an input end and an output end;

a first dielectric layer disposed over the coupling region;

a second metal layer configured as a strip conductor disposed on the first dielectric layer over the coupling region, the second metal layer having one end disposed on, and electrically connected to, the output end of the second lower strip conductor and having a second end disposed on, and electrically connected to the input end of the third lower strip conductor; and a second dielectric layer is disposed over the second metal layer and between the pair of ground pads; and an electrically conductive shield layer disposed on an upper surface of the second dielectric layer extending over sides of the second dielectric layer and onto the pair of ground pads.

13. The radio frequency coupler recited in claim 12 wherein the first metal layer is patterned to provide a second pair of ground pads on, and separated by, different portions of the upper surface of the dielectric substrate the coupling region being disposed between the second pair of ground pads, the first-mentioned pair of ground pads, the first-mentioned pair of ground pads and the second pair of ground pads being disposed along perpendicular lines, the electrically conductive shield layer being disposed over a second pair of opposing sides of the dielectric layer and onto the second pair of ground pads.

14. The radio frequency coupler recited in claim 13 wherein one of the first lower strip conductors pass between one of the first mentioned pair of ground pads and one of the second pair of ground pads.

15. The radio frequency coupler recited in claim 14 wherein a second one of the second lower strip conductors pass between a second one of the first mentioned and a second one of the second pair of ground pads.

16. The radio frequency coupler recited in claim 12 wherein the electrically conductive shield layer is a conductive ink.

17. The radio frequency coupler recited in claim 12 wherein the portions of the electrically conductive shield layer are disposed on sides of the first dielectrics layer and sides of the second dielectric layer and over portions of the upper surface of the dielectric substrate.

18. A method for tuning a radio frequency coupler, comprising:

(a) providing a radio frequency coupler comprising: a dielectric substrate; a pair of strip conductors disposed over an upper surface of the dielectric substrate, a first portion of the pair of strip conductors being in an overlying relationship and separated by a first dielectric layer to provide a coupling region between the portion of the pair of strip conductors in the overlying relationship; a second portion of the pair of strip conductors being disposed on the upper surface of substrate; and a pair of opposing ground pads disposed on the upper surface of the substrate, the coupling region being disposed between the pair of opposing ground pads;

(b) measuring a degree coupling between the pair of strip conductors;

(c) comparing the measured degree of coupling with a predetermined degree of coupling;

(d) adjusting a width of an upper one of the pair of strip conductors widths;

(e) repeating (b) through (d) until the degree of coupling reaches the predetermined degree coupling-.

* * * * *